United States Patent [19]

Peterson

[11] 3,971,083

[45] July 27, 1976

[54] SIDE GUARD FOR BEDS

[75] Inventor: Warren J. Peterson, Stevens Point, Wis.

[73] Assignee: Joerns Furniture Company, Stevens Point, Wis.

[22] Filed: Nov. 27, 1974

[21] Appl. No.: 527,522

[52] U.S. Cl. ..... 5/331; 5/100
[51] Int. Cl.[2] ..... A47C 21/00
[58] Field of Search ..... 5/331, 100; 248/161

[56] References Cited

UNITED STATES PATENTS

| | | | |
|---|---|---|---|
| 3,055,020 | 9/1962 | Mann | 5/331 |
| 3,125,769 | 3/1964 | Black et al. | 5/331 |
| 3,526,008 | 9/1970 | Pruim | 5/331 |
| 3,585,659 | 6/1971 | Burst et al. | 5/331 |
| 3,840,917 | 10/1974 | Taylor | 5/100 |
| 3,857,122 | 12/1974 | Bryant | 5/100 |

*Primary Examiner*—Robert L. Wolfe
*Assistant Examiner*—Andrew M. Calvert
*Attorney, Agent, or Firm*—Price, Heneveld, Huizenga & Cooper

[57] ABSTRACT

A safety bed rail assembly especially adapted for hospital beds including means for pivoting the rail between raised and lowered positions with respect to the bed mattress. Release means for operation by a knee of a nurse or other attendant are included to pivot the rail between said positions. The pivotal movement is limited such that the rail always pivots away from the release means to prevent pinching or trapping of the knee by the pivot mechanism.

24 Claims, 6 Drawing Figures

SIDE GUARD FOR BEDS

BACKGROUND OF THE INVENTION

This invention relates to side guards or rails for beds and, more particularly, to safety bed guards or rails movable between raised and lowered positions and mechanisms for moving the rails between such positions.

Safety bed rails and side guards especially adapted to prevent persons from falling out of bed and to assist persons getting into and out of bed are well-known. Many prior known bed guards are movable between a raised position in which the bed guard is supported at a level above the surface of the bed mattress and a retracted or lowered position in which the bed guard is either moved out of the way toward one end of the bed or lowered to a position below the mattress.

A major problem encountered with such bed guards, and especially in hospitals, nursing homes, or other extended care facilities where such guards are primarily used, is the operation of such guards by persons who are concentrating on or engaged in other activities. Thus, a doctor, nurse, therapist, or other attendant often is carrying other objects to or from the bed at the time the bed guard must be lowered. In such instances, the attendant cannot use both hands to operate the guard mechanism. It is, therefore, desirable to have a guard positioned and designed so as to be operable by the knee of an attending person.

While many types of operating mechanisms have been previously devised for movable bed guards, some of which are operable by the knee of an attending person, such prior guards have been susceptible to pinching or otherwise injuring the extremity of the attending person which is used to operate the lowering or retracting mechanism. Thus, it is necessary to carefully operate such devices to prevent injury.

Further, the beds or bed frames must be radically modified with special fittings in order to mount certain of the prior guards. This severely restricts the use of such guards with various types of beds. It is, therefore, especially desirable to have a compact safety guard unit which may be easily mounted and removed from virtually any bed without the necessity of specially designed structure.

SUMMARY OF THE INVENTION

Accordingly, it is an object and purpose of the present invention to provide a safety bed rail or guard assembly especially adapted for hospital beds which is movable between raised and lowered positions and which includes a latch apparatus which may be released with the knee of an attending person in such a manner as to prevent injury of that person's knee during such movement. The safety bed rail assembly includes a pivot assembly adapted to allow movement between the raised and lowered position without injury to the operator. The entire assembly may be removably attached to the mattress frame of a bed and is small and compact enough to move with the mattress frame if the frame is of the articulated variety providing various bed positions. In its raised position, the safety rail prevents persons in bed from falling out of bed and provides useful assistance in moving into and out of bed. In the lowered position, the guard is positioned below the mattress level to allow a nurse or other bed attendant to tuch bed clothes under the mattress without the rail obstructing the operation and to move easily around the bed and patient to administer injections or other treatments. When so lowered, the rail is spaced sufficiently above the floor to provide clearance for cleaning and movement of stands and the like thereunder. The assembly also is thin and narrow and thus unobtrusive when mounted on the bed.

In one form, the invention is a safety rail assembly for hospital beds comprising a safety rail, pivot means for supporting said rail and moving said rail between at least a raised position generally above the mattress of a bed and a lowered positon generally below said mattress. Latch means are included for holding the safety rail in said raised positions including release means extending from one end of said latch means for movement by a knee of a person to allow pivotal movement of the rail between said positions without the necessity of using one's hands to effect such release. Structure is included for limiting the pivotal movement away from the release means whereby the pivot means and rail are prevented from striking the person's knee as said rail is raised or lowered.

In the preferred embodiment, the latch means is completely enclosed within a compact housing and includes a sliding latch plate having a closed slot engaging a portion of the pivot means for supporting and pivoting the safety rail. The slot and pivot portion cooperate to hold the rail in its raised position until released with said specially positioned release means.

These and other objects, advantages, purposes, and features of the invention will become more apparent from a study of the following description taken in conjunction with the drawings.

DESCRIPTION OF THE PREFERRED EMBODIMENT

Figure 1:
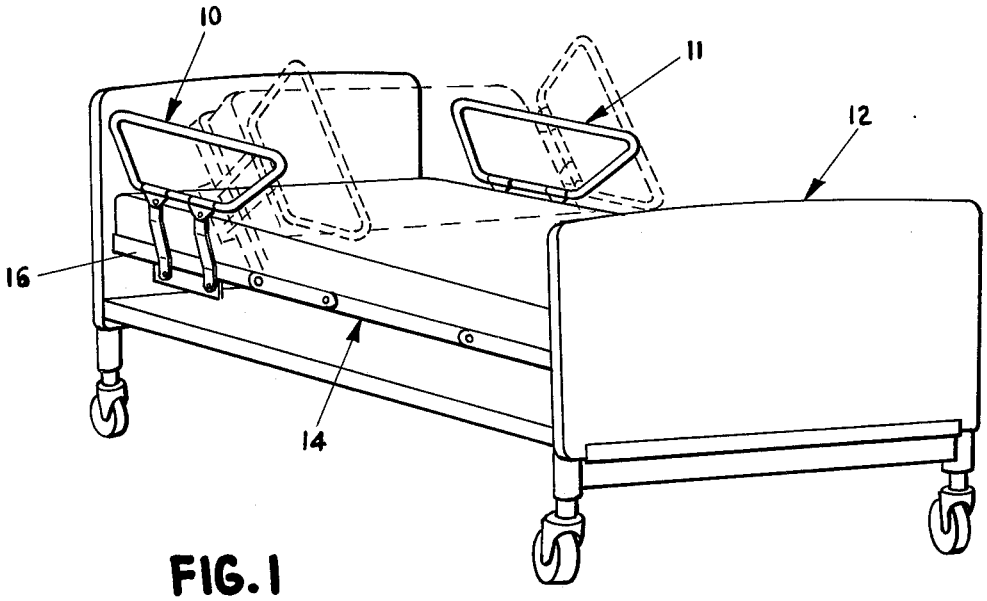
FIG. 1 is a perspective view of a pair of the safety bed rail assemblies secured on either side of the head section of a hospital bed having a hinged mattress frame.
Figure 2:
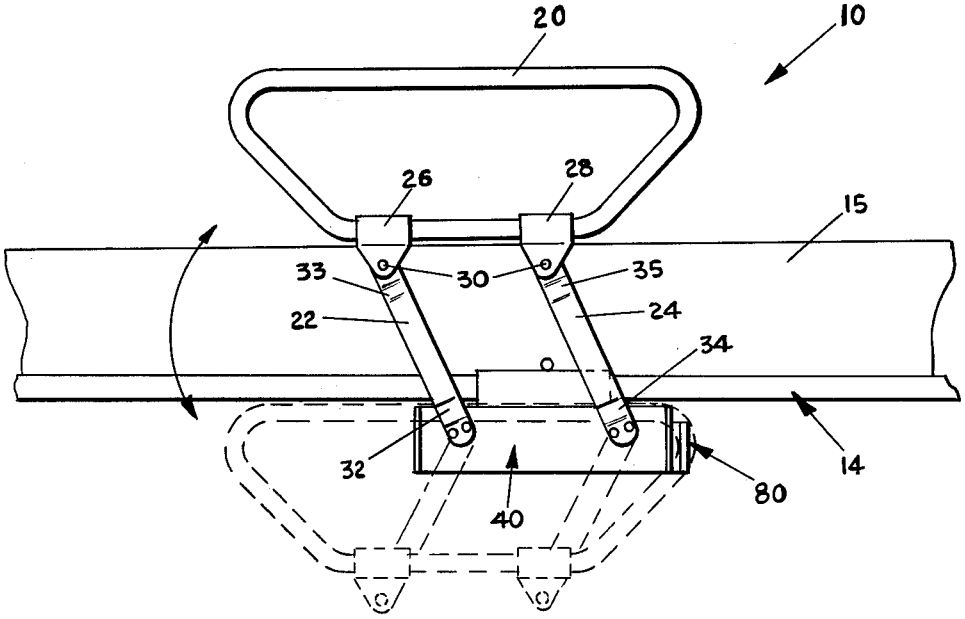
FIG. 2 is an elevation of the safety bed rail assembly shown in FIG. 1 illustrating pivotal movement thereof between its raised and lowered positions.

Referring now to the drawings in greater detail, FIG. 1 illustrates left-hand embodiment 10 and right-hand embodiment 11 of the present safety bed rail assembly mounted on the head section 16 of an articulated mattress frame 14 of a hospital bed 12. The hinged mattress frame includes a plurality of hinge points enabling the head and leg sections of the frame and mattress to be moved upwardly into various positions in the conventionally known manner. As shown in FIG. 2, the safety rail or guard may be pivoted between a raised position (shown in solid) wherein the closed loop rail portion is supported above the level of the mattress resting on mattress frame 14 and a lower position (shown in phantom) wherein rail 20 is below the mattress level. The safety rail assemblies 10 and 11 are entirely movable with the head section such that they remain in a useful position even when the head section is tilted upwardly as shown in FIG. 1. Since embodiments 10 and 11 are formed from identical parts with the assembly thereof being slightly modified such that one is the mirror image of another, only the left-hand embodiment 10 of the assembly will be described herein.

Assembly 10 includes a closed loop safety rail 20, a pair of pivotal, parallel support arms 22, 24 and a pivot and latch assembly 40. As is best seen in FIG. 2, latch assembly 40 includes a release member 80 extending from one end thereof and adapted to be operated by the knee of a nurse or other bed attendant without requiring the attendant to use his or her hands for such release. Further, the pivot and latch assembly 40 limits the movement of rail 20 such that it always pivots away from the release member 80 regardless of whether it is being raised or lowered in order to prevent pinching, trapping, or other injury to the person operating the same and releasing the rail for movement with member 80. In the preferred embodiment, such pivotal movement is always toward the head of the bed in order to prevent interference with controls for articulated beds which are normally centrally located on the bed frame.

Figure 5:
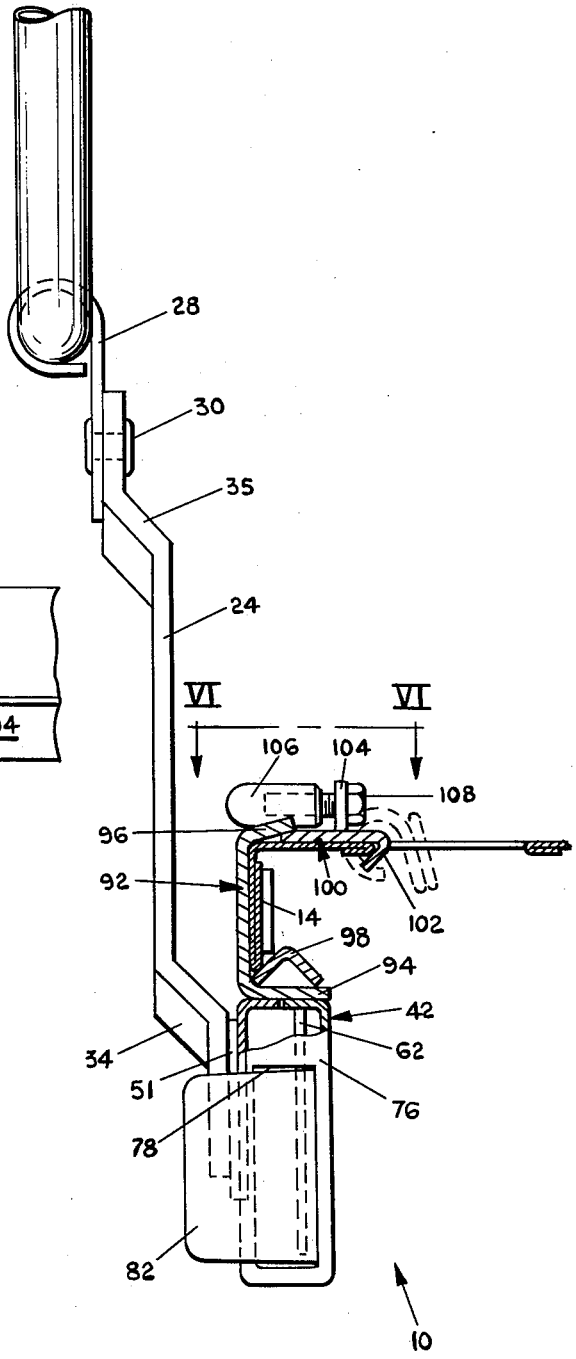
FIG. 5 is a fragmentary, end elevation of the assembly, shown partially in cross section, illustrating its mounting on a mattress frame of a hospital bed.

As shown in FIGS. 1, 2, and 5, the safety rail 20 is a circular, tubular member formed for strength in a closed loop from steel or the like and having the general shape of isosceles trapezoid with its longer, parallel side being uppermost. Rail 20 is typically about one-third the length of a typical hospital bed. In some instances, a pair of the one-third length rail assemblies is used on each side of a bed. Rail 20 is supported above the pivot and latch assembly 40 by the parallel support arms 22, 24 which are pivotally secured to a pair of brackets 26 and 28 curved around the shorter, parallel side of the rail. Rivets 30 pivotally secure the upper ends of arms 22, 24 to the brackets 26, 28 respectively. In order to keep the overall width of the entire assembly as small as possible, rail 20 is spaced closely widthwise to the pivot and latch assembly 40 (FIG. 5). However, to allow room for grasping the rail during movement thereof, rail support arms 22, 24 include offset portions 32, 33 and 34, 35 respectively.

Figure 4:
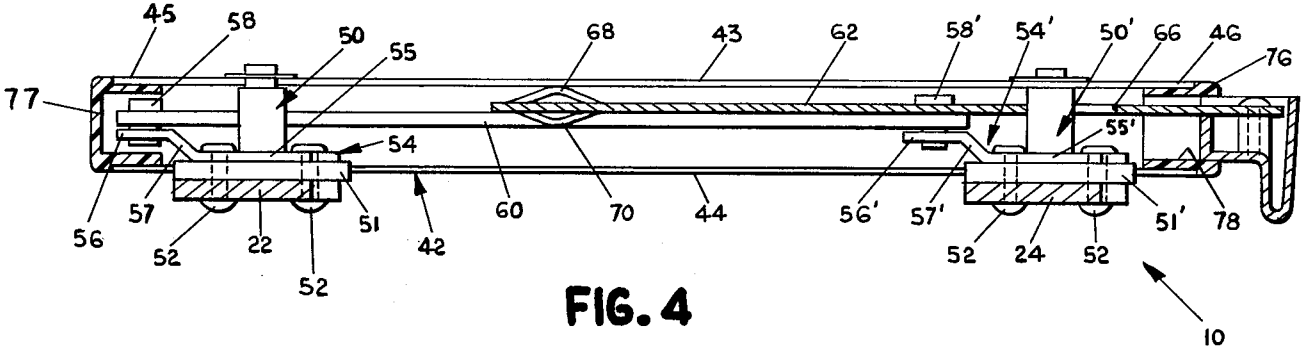
FIG. 4 is a sectional, plan view of the pivot and latching portions taken along line IV—IV of FIG. 3.
Figure 3:
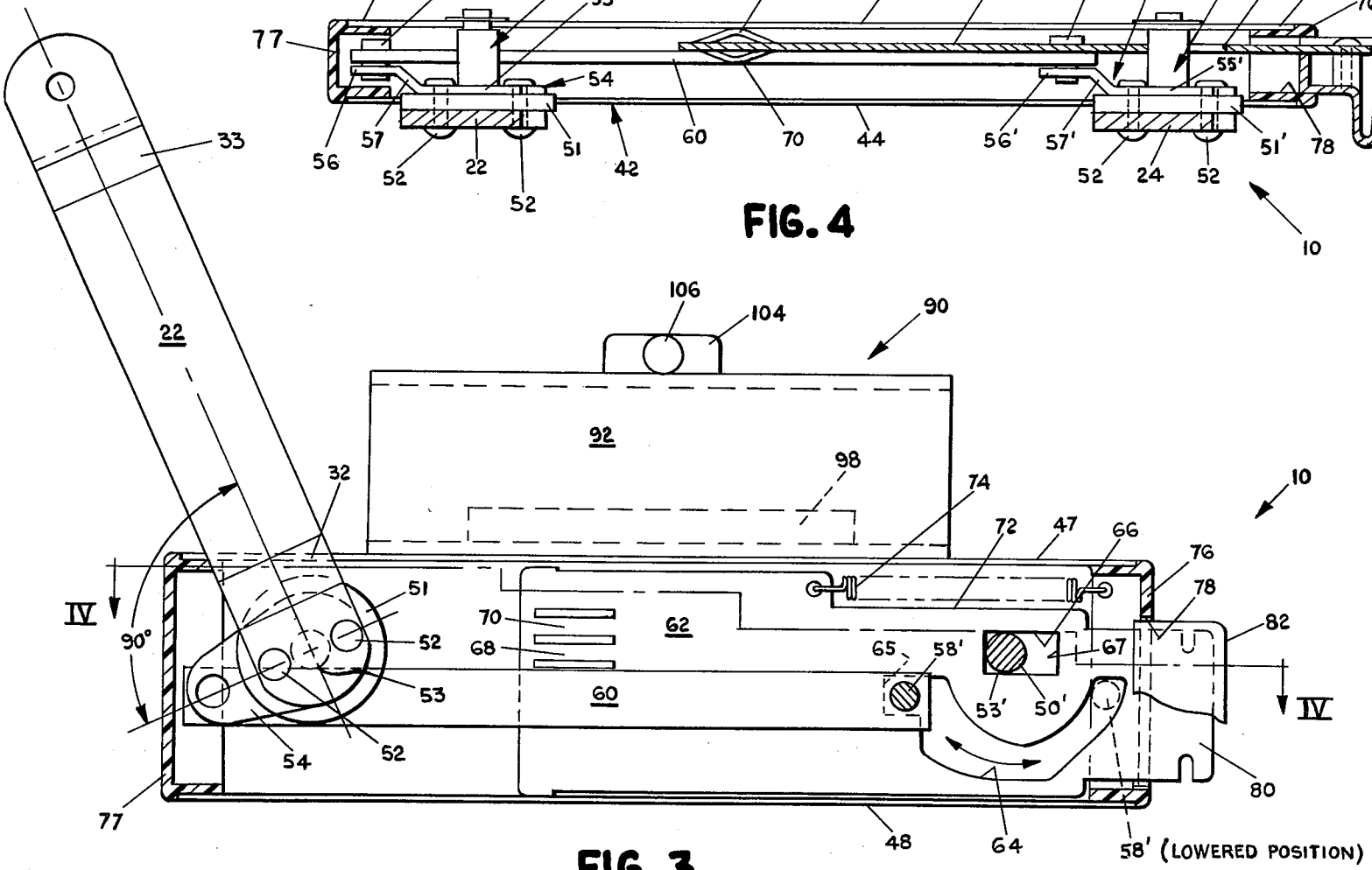
FIG. 3 is a sectional elevation of the pivot and latching portions of the assembly shown in FIGS. 1 and 2.

Referring now to FIGS. 3–5, pivot and latch assembly 40 includes an elongated, rectangular housing 42 having an inner wall 43, an outer wall 44, left and right ends 45 and 46, and top and bottom walls 47, 48 respectively. As is best seen in FIG. 5, housing 42 may be manufactured by welding or otherwise securing together a pair of channel-like members along a central seam on the top and bottom walls. Preformed tubing may also be utilized. The lower end of each of the rail support arms, 22, 24 are respectively secured by pairs of rivets or other fasteners 52 to the disc-like face portions 51, 51′ of pivot hubs or shafts 50, 50′. Pivot hubs or shafts 50, 50′ extend across the entire width of the housing 42 between inner and outer walls 43, 44 and are rotatably supported or journaled in suitable circular apertures in those respective sides. Rivets 52 also secure, on the rear side of disc-like face portions 51, 51′, crank arms 54 and 54′. Crank arms 54 and 54′ are secured with their longitudinal axes at 90° to the longitudinal axes of the rail support arms 22, 24, respectively (FIG. 3). The larger ends 55 and 55′ of the crank arms include central apertures therein through which the pivot shafts 50 are telescoped before assembly. The smaller ends 56, 56′ of the crank arms include apertures in which are mounted pivot studs 58, 58′. Small end portions 56, 56′ are offset toward the center of the housing by portions 57, 57′. Rail support arms 22, 24 are maintained parallel to one another at all times by their attachment to the rail and by an elongated connecting link 60 which is pivotally secured to the apertures in the small ends 56, 56′ of crank arms 54, 54′ by pivot studs 58, 58′. Support arms 22, 24 remain parallel to one another regardless of whether they are raised or lowered.

In order to hold the safety rail 20 and its pivot apparatus either in the raised or lowered position as desired, a latch assembly is included as is best seen in FIG. 3. The latch assembly includes an elongated, generally rectangular, generally planar latch plate 62 having a generally arcuate, closed slot 64, a rectangular slot 66, a pair of lanced projections 68 and 70, and an elongated notch 72 in its top edge. Plate 62 is slidably mounted within housing 44 on the bottom thereof between link 60 and the inside surface of inside wall 43. The projections 68 (left-hand assembly) or 70 (right-hand assembly) and slot 66 guide the sliding movement of the plate. Projection 68 spaces plate 62 away from inside wall 43 and against the side of link 60. Projection 70 extends oppositely of projection 68 and allows the identical plate to be used in the right-hand embodiment 11 of the assembly for spacing the plate between the inside wall and link of that assembly. The shaft portion of pivot hub or shaft 50′ extends through rectangular slot 66. Slot 66 thus defines the limits of sliding movement for plate 62.

As shown in FIGS. 3 and 4, pivot stud 58′ at the right end of link 60, which pivotally connects link 60 with crank are 54′, is received in slot 64 in plate 62. Slot 64 includes a square-shaped notch or cut-out portion 65 at its left end in which stud 58′ is received when rail 20 is in its raised position as shown in FIG. 3. Contact between the bottom of stud 58′ and the bottom edge of notch 65 prevents the downward pivoting of the rail and pivot assembly.

The rail and support arms are stopped in the positions shown in FIG. 2 by contact between shafts 50 and 50′ and link 60. In the raised position, the bottom 53 of shaft 50 engages the top edge of link 60 to prevent further upward (clockwise) pivoting. At the same time, notch 65 engages stud 58′ to hold the rail as raised. In the lowered position, the bottom 53′ of shaft 50′ engages the top edge of the other end of link 60 to prevent further downward (counterclockwise) pivoting. Stud 58′ is accordingly not forced against the ends of slot 64. Also, such structure prevents the rail and arms from pivoting toward the release apparatus 80.

In order to hold the latch plate 62 in the securing position for the raised position, a coil spring 74 extends between an aperture in plate 62 and an aperture in plastic end cap 76 along notch 72 in the top edge of the plate to bias plate 62 toward housing end 46. End cap 76 includes a rectangular 78 therein (FIGS. 4 and 5) through which a flange 80 of latch plate 62 extends. The opposite end 45 of the housing is filled by a plastic closed end cap 77. A plastic flange member 82, having a flange 83 extending away from mattress frame 14, is secured over the end of flange 80 and has a height and width approximating the dimensions of the opening 78 in end cap 76 in order to provide additional guidance for sliding the latch plate.

To release pivot stud 58' from notch 65 and enable the stud to enter the arcuate part of slot 64 such that the rail 20 and its pivotal support apparatus may be pivoted to the lowered position, plate 62 is slid into the housing against the biasing force of spring 74 via flange 80 and flange member 82 (toward the left in FIG. 3). Such movement of the plate 62 prevents the bottom of notch 65 from contacting stud 58' and allows the stud 58', link 60, crank arms 54 and 54', pivot hubs 50 and 50', support arms 22 and 24, and rail 20 to pivot downwardly until the stud 58' is stopped by contact between bottom 53' of shaft 50' and the top edge of link 60 and stud 58' is in the position shown in phantom in FIG. 3. The inward movement of plate 62 against the force of spring 74 is limited by right end 67 of slot 66 which contacts the shaft portion of pivot hub or shaft 50'.

Slot 64 has a generally half-loop, irregular, closed configuration providing sufficient room for the swinging movement of stud 58' in the end of crank arm 54'. In the raised position, support arms 22, 24 are inclined to the vertical away from the release apparatus 80 as they also are in the lowered position. Should the safety rail slip from the grasp of the operator during pivotal movement, the center of gravity of the safety rail and rail support arms cause it to fall away from the release apparatus preventing any pinching or trapping of any extremity of the operator. To raise the safety rail, it is merely necessary to swing it to its raised position without touching the release apparatus. However, when the bed is tilted as in FIG. 1, the force of gravity acting on the center of gravity of the rail holds it in its raised position. When so tilted, the rail must be pushed past the vertical position. In the lowered position, the end of the closed loop safety rail 20 will be seen to be coextensive with the release apparatus 80 thereby preventing contact with the release apparatus and avoiding any confusion as to whether the release means needs to be pushed to raise the safety rail. When the rail reaches the raised position, such that notch 65 is in generally horizontal registry with the stud 58', the biasing force of spring 74 will pull latch plate 72 to the right (in FIG. 3) to securely latch and hold the rail in its raised position until released by release flange 80.

As will also be understood, crank arms 54, 54' extend at right angles to rail support arms 22, 24 in order to provide the maximum mechanical advantage or torque on stud 58'. Such torque maintains the maximum contact force between stud 58' and notch 65 to hold the rail in its raised position.

Assembly of the safety rail assembly in either its left-hand or right-hand embodiments is simply accomplished. For right-hand embodiment 11, the positions of end caps 76 and 77 are reversed. Latch plate 62 is rotated 180° such that flange 80 extends through opening 78 in the opposite end of housing 42 from the left-hand embodiment. In such case, projection 70 spaces plate 62 away from the inside of wall 43 toward link 60. Also, crank arms 54 and 54' must be assembled on support arms 22, 24 with ends 56, 56' extending in the opposite direction from that shown in FIG. 3 so that ends 56, 56' will extend toward the head of the bed in either right or left models. The remainder of the assembly is the same.

Figure 6:
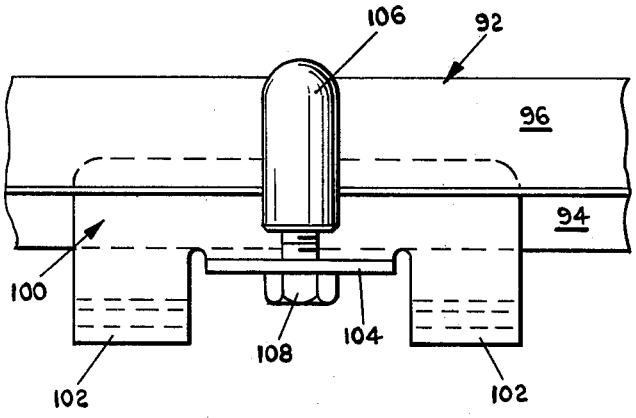
FIG. 6 is a fragmentary, plan view of the apparatus for mounting the safety rail assembly on a hospital bed taken along line VI—VI of FIG. 5.

As will be best seen in FIGS. 3, 5, and 6, the entire safety bed rail assembly 10 is removably secured to the mattress frame 14 by the clamping assembly 90. Assembly 90 includes a channel-like bracket 92 having a generally U-shaped cross-sectional shape including leg flanges 94 and 96. Bracket 92 is secured to the top wall 47 of housing 42 along bottom leg 94 by welding or the like. An elongated inverted V-shaped channel 98 is secured by welding or the like along the inside of bottom leg flange 94 to hold the side member of mattress frame 14 against the inside surface of bracket 92 (FIG. 5). Together, bracket 92 and channel 98 provide longitudinal stability of the rail assembly 10 on frame 14.

A slidable, generally J-shaped clamping bracket 100 having a hook flange 102 and an upstanding securing flange 104 engages the top flange of mattress frame 14. An anchor nut 106 is secured to the top of leg flange 96 of bracket 92 and is engaged by a threaded bolt 108 extending through upstanding flange 104. Bracket 100 is securely drawn toward and under leg 96 of bracket 92 by bolt 108 to securely clamp mattress frame 14 therebetween and secure the entire safety rail assembly to the mattress frame. Since leg 96 is inclined downwardly as shown in FIG. 5, tightening of bolt 108 both pulls frame 14 toward brackets 92 and wedges frame 14 vertically downwardly against channel 98 into the V-shaped area between channel 98 and the inside surface of channel 92.

As will now be understood, the pivot and latch assembly 40 is completely enclosed within the housing 42 except for the release flange 80 and flange member 82 extending from one end thereof. The release apparatus is especially adapted for operation by the knee of a nurse or another attendant to obviate the necessity of using one's hand to release the same. The safety rail is limited to pivot downwardly or upwardly away from the release apparatus such that the person releasing the assembly will not be injured by the movement of the rail.

While one form of the invention has been shown and described, other forms will now be apparent to those skilled in the art. Therefore, it will be understood that the embodiment shown in the drawings and described above is merely for illustrative purposes and is not intended to limit the scope of the invention which is defined by the claims which follow.

The embodiments of the invention in which an exclusive property or privilege is claimed are defined as follows:

1. A safety rail assembly for hospital beds comprising a safety rail; pivot means for supporting said rail and moving said rail between at least a raised position generally above the mattress of a bed and a lowered position generally below the said mattress; latch means for holding said safety rail in said raised position including release means extending from one end of said latch means for movement by a knee or other portion of a person's body to allow said pivotal movement of said rail between said positions, said release means avoiding the strict necessity of using only one's hand or hands to release the rail; and means for limiting pivotal movement of said rail to a pivotal direction away from said release means whereby said pivot means and rail are prevented from striking said person's knee or any other portion of a person's body used to operate the release means as said rail is raised or lowered.

2. The safety rail assembly of claim 1 wherein said latch means is enclosed in an elongated housing having a pair of opposite side surfaces and a pair of ends; said pivot means extending from one of said side surfaces, said release means extending from one of said housing ends generally parallel to said one side surface.

3. The safety rail assembly of claim 2 including means for securing said assembly to the mattress frame of a hospital bed, said securing means being located on said housing and adapted to secure said housing generally parallel to the said mattress frame along one side of a bed such that said one housing end is farthest away from the head of the bed.

4. The safety rail assembly of claim 1 wherein said latch means include a sliding latch plate having a arcuate slot formed within said latch plate and receiving a projecting portion of said pivot means; said release means including sliding means for sliding said latch plate such that said projecting portion of said pivot means is in registry with a different area of said slot.

5. The safety rail assembly of claim 1 including a housing having a side surface, said pivot means including a pair of parallel, spaced rail support arms each having first and second ends; the first ends of said arms being pivotally secured at spaced points on said safety rail, said second ends of said arms being secured to spaced, pivot hubs extending through said housing side surface.

6. The safety rail of claim 5 wherein said pivotal movement limiting means include link means for connecting said pivot hubs within said housing, said link means engaging said pivot hubs to prevent pivotal movement beyond said raised and lowered positions and to prevent said rail from being pivoted toward said release means.

7. The safety rail assembly of claim 5 wherein said latch means includes a limit slot receiving a portion of one of said pivot hubs for limiting sliding movement of said latch plate between a securing position and a release position and an arcuate slot receiving a portion of said pivot means to hold said rail and pivot means in said raised position.

8. The safety rail assembly of claim 7 wherein said latch means includes a latch plate having a notch at one end of said arcuate slot; said pivot means and pivotal movement limiting means including a crank arm extending from each of said pivot hubs and connecting link means extending between said crank arms for maintaining said support arms parallel to one another; said connecting link means connected to said crank arms by a pivot stud in each crank arm; one of said pivot studs being received in said notch when said latch plate is in said securing position to hold said rail and support arms in said raised position, said pivot studs engaging said connecting link means to prevent pivotal movement of said rail toward said release means.

9. The safety rail of claim 8 including biasing means for biasing said latch plate into said securing position; said latch plate inluding at least one projection extending laterally thereof for positioning said latch plate within said housing and guiding sliding movement thereof; said release means including a flange extending through one end of said housing to allow movement of said latch plate against the force of said biasing means to release said pivot stud from said notch.

10. The safety rail of claim 7 wherein said arcuate slot curves generally downwardly then upwardly in a halfloop type fashion; said latch means including means adjoining said slot for engaging said portion of said pivot means to retain said rail and pivot means in said raised position.

11. The safety rail of claim 10 wherein said latch means includes an elongated, generally planar plate; said release means including a flange extending from one end of said plate through one end of said housing; said arcuate slot located in said plate immediately adjacent said flange; said limit slot being rectangular and located immediately above said arcuate slot adjacent said flange.

12. A safety rail assembly for hospital beds comprising a housing; a support rail; a pair of parallel rail support arms each having first and second ends extending from said housing including means at the first end of each of said arms for pivotally connecting said arm and rail; and means included with said housing for pivoting said support arms between at least a raised position in which said rail is supported above the level of a mattress when placed on the a mattress frame for supporting the mattress, and a lowered position in which said rail is supported below the said mattress level; said pivot means including a pair of pivot shafts for pivotally connecting the second ends of said support arms to said housing; and latch means enclosed within said housing for holding said rail in said raised position including release means extending from one end of said housing for movement by a knee or other portion of a person's body to allow movement of said rail between said positions and means for limiting pivotal movement of all of said support arms and rail to a pivotal direction away from said one end including said release means whereby said support arms and rail are prevented from striking said person's knee or any other portion of a person's body used to operate said release means as said rail is raised or lowered.

13. The safety rail assembly of claim 12 wherein said latch means include a sliding latch plate having an arcuate slot formed therein and receiving a projecting portion of said pivot means; said release means including sliding means for sliding said latch plate such that said projecting portion of said pivot means is in registry with a different area of said slot.

14. The safety rail assembly of claim 12 wherein said pivot shafts each include a pivot axis and a crank arm secured at a right angle to said pivot axis within said housing; said pivotal movement limiting means including link means pivotally connecting said crank arms for engaging said pivot shafts and limiting movement of said support arms and rail away from said release means.

15. The safety rail assembly of claim 14 wherein said latch means include a latch plate slidably mounted within said housing; release means including a flange on one end of said latch plate extending through said one end of said housing, said latch means including biasing means biasing said latch plate toward said one housing end.

16. The safety rail assembly of claim 15 wherein said link means include an elongated connecting link having two ends and a pair of pivot studs, each pivot stud located adjacent the end of one of said crank arms and pivotally connecting one end of said connecting link to the respective crank arm; said latch plate including an arcuate slot having a notch in one end for holding said rail and pivot means in said raised position, said arcuate slot being located adjacent said flange, and a second slot immediately above said arcuate slot, said arcuate slot receiving one of said pivot studs to govern pivotal movement of said rail and pivot means and said second slot receiving one of said pivot shafts therethrough to limit sliding movement of said latch plate.

17. The safety rail assembly of claim 16 wherein said latch plate includes a projection extending laterally thereof for guiding sliding movement of said latch plate within said housing.

18. The safety rail assembly of claim 12 including attaching means for securing said assembly to the mattress frame of a hospital bed including a U-shaped bracket secured to the top of said housing for receiving a side flange of a mattress frame, an elongated upstanding guide member secured to one leg of said U-shaped bracket for positioning the side flange of the mattress frame within said U-shaped bracket, a J-shaped bracket for hooking over a top flange of the mattress frame, and fastening means for securing said J-shaped bracket to said U-shaped bracket whereby the mattress frame is clamped therebetween.

19. The safety rail assembly of claim 18 wherein said U-shaped bracket includes an upper leg flange which is inclined downwardly and a bottom leg flange; said guide member having the shape of an inverted "V" and secured along the inside of said bottom leg flange; said J-shaped bracket being wedged under said downwardly inclined upper flange by said fastening means whereby the mattress frame is drawn inwardly against the inside surface of said U-shaped bracket and wedged vertically downwardly against said guide member.

20. A safety rail assembly for hospital beds comprising a rail; pivotal support means for pivoting said rail between at least raised and lowered positions, said pivotal support means including a projecting member movable with said pivotal support means; sliding latch means movable between first and second positions for holding said rail and pivotal support means in said raised position including a slot having first and second portions, said projecting member received in and prevented from movement by said slot first portion when said latch means is in said first position such that said rail and pivotal support means is held in said raised position, said projecting member being moved by said pivotal support means through said slot from said first slot portion to said second slot portion and received in said second slot portion when said latch means is in said second position such that said rail and pivotal support means are movable to said lowered position; release means for sliding said latch means between said positions to allow movement of said rail.

21. The safety rail assembly of claim 20 wherein said sliding latch means includes a sliding latch plate; said slot having an arcuate second portion and a rectilinear first portion which adjoins and merges with said second portion.

22. The safety rail assembly of claim 20 including a housing enclosing said sliding latch means, said sliding latch means including a sliding latch plate, said release means including a flange on said latch plate extending from one end of said housing for operation with the knee or another portion of a person's body.

23. The safety rail assembly of claim 20 including means for limiting pivotal movement of said rail and pivotal support means to a pivotal direction away from said release means.

24. The safety rail assembly of claim 20 including biasing means for biasing said sliding latch means toward said first position.

* * * * *

UNITED STATES PATENT AND TRADEMARK OFFICE

CERTIFICATE OF CORRECTION

PATENT NO. : 3,971,083

DATED : July 27, 1976

INVENTOR(S) : Warren J. Peterson

It is certified that error appears in the above-identified patent and that said Letters Patent are hereby corrected as shown below:

Column 4, line 60;
After "rectangular" insert --opening--;
Column 7, line 33 (Claim 7);
Delete the word "plate" and substitute --means--.

Signed and Sealed this

Nineteenth Day of October 1976

[SEAL]

*Attest:*

RUTH C. MASON
*Attesting Officer*

C. MARSHALL DANN
*Commissioner of Patents and Trademarks*